US011707169B2

(12) United States Patent
Kim et al.

(10) Patent No.: US 11,707,169 B2
(45) Date of Patent: Jul. 25, 2023

(54) ROBOT CLEANER

(71) Applicant: LG ELECTRONICS INC., Seoul (KR)

(72) Inventors: Hyosung Kim, Seoul (KR); Bohyun Nam, Seoul (KR); Sojin Park, Seoul (KR); Jin-Ju Kim, Seoul (KR); Sehwan Bae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 531 days.

(21) Appl. No.: 16/774,439

(22) Filed: Jan. 28, 2020

(65) Prior Publication Data

US 2020/0163506 A1 May 28, 2020

Related U.S. Application Data

(63) Continuation of application No. 15/749,689, filed as application No. PCT/KR2016/009677 on Aug. 31, 2016, now abandoned.

(30) Foreign Application Priority Data

Aug. 31, 2015 (KR) ..... 10-2015-0122967
Sep. 1, 2015 (KR) ..... 10-2015-0123430

(51) Int. Cl.
*A47L 9/04* (2006.01)
*A47L 5/22* (2006.01)
(Continued)

(52) U.S. Cl.
CPC ..... *A47L 9/04* (2013.01); *A47L 5/225* (2013.01); *A47L 9/02* (2013.01); *A47L 9/2805* (2013.01);
(Continued)

(58) Field of Classification Search
CPC .. A47L 9/24; A47L 9/2894; A47L 9/28–2805; A47L 9/242; A47L 9/248;
(Continued)

(56) References Cited

U.S. PATENT DOCUMENTS 4,811,452 A * 3/1989 Sumerau ..... A47L 5/32 15/333
5,355,549 A 10/1994 Steinberg et al.
(Continued)

FOREIGN PATENT DOCUMENTS

GB 2 409 966 7/2005
JP S58-27738 2/1983
(Continued)

OTHER PUBLICATIONS

Japanese Notice of Allowance dated Oct. 16, 2020 issued in JP Application No. 2018-508144.
(Continued)

*Primary Examiner* — David Redding
*Assistant Examiner* — Robert F Neibaur
(74) *Attorney, Agent, or Firm* — Ked & Associates LLP

(57) ABSTRACT

A robot cleaner includes a main body having a suction motor; a moving unit to automatically move the main body; and a suction module to be in communication with the suction motor and to clean a floor, wherein an accommodating portion in which a part of the suction module is accommodated is provided at a lower portion of a front side of the main body, and while the suction module is located in the accommodating portion, a part of the suction module is disposed to be vertically overlapped with the main body, and another part of the suction module protrudes toward both sides from a front portion of the main body, and still another part of the suction module protrudes to a front of the main body.

10 Claims, 18 Drawing Sheets

(51) Int. Cl.
*A47L 9/28* (2006.01)
*A47L 9/02* (2006.01)
*A47L 9/24* (2006.01)

(52) U.S. Cl.
CPC ..... *A47L 9/2852* (2013.01); *A47L 9/2857* (2013.01); *A47L 9/24* (2013.01); *A47L 2201/00* (2013.01); *A47L 2201/04* (2013.01)

(58) Field of Classification Search
CPC ... A47L 5/225; A47L 5/36; A47L 5/32; A47L 2201/00; A47L 2201/04; A47L 2201/06; A47L 9/04; A47L 9/02
USPC ..... 15/334, 335
See application file for complete search history.

(56) References Cited

U.S. PATENT DOCUMENTS

| | | | | |
|---|---|---|---|---|
| 5,534,762 | A | 7/1996 | Kim | |
| 7,240,395 | B2 * | 7/2007 | Clarke | E01H 1/0827 15/338 |
| 7,690,078 | B2 * | 4/2010 | Zahuranec | A47L 5/30 15/337 |
| 7,779,504 | B2 * | 8/2010 | Lee | A47L 5/225 15/328 |
| 8,240,000 | B2 | 8/2012 | Oh et al. | |
| 8,452,450 | B2 | 5/2013 | Dooley et al. | |
| 8,635,739 | B2 * | 1/2014 | Lee | A47L 9/20 15/352 |
| 8,961,695 | B2 * | 2/2015 | Romanov | A47L 11/4011 15/340.1 |
| 9,002,482 | B2 | 4/2015 | Tsuboi | |
| 9,532,690 | B2 * | 1/2017 | Jang | A47L 5/225 |
| 9,795,261 | B2 * | 10/2017 | Krebs | A47L 5/225 |
| 2001/0004719 | A1 | 6/2001 | Sommer | |
| 2002/0002751 | A1 | 1/2002 | Fisher | |
| 2004/0031113 | A1 | 2/2004 | Wosewick et al. | |
| 2007/0157416 | A1 * | 7/2007 | Lee | A47L 9/2894 15/328 |
| 2010/0324734 | A1 | 12/2010 | Lee et al. | |
| 2011/0160903 | A1 | 6/2011 | Romanov et al. | |
| 2015/0114155 | A1 | 4/2015 | Park et al. | |
| 2015/0208891 | A1 | 7/2015 | Jang et al. | |
| 2016/0051108 | A1 | 2/2016 | Huang et al. | |
| 2017/0332857 | A1 | 11/2017 | Nam et al. | |

FOREIGN PATENT DOCUMENTS

| | | |
|---|---|---|
| JP | S59-34183 | 2/1984 |
| JP | S60-147351 | 9/1985 |
| JP | S63-77426 | 4/1988 |
| JP | 2001-258806 | 9/2001 |
| JP | 2001-258809 | 9/2001 |
| JP | 2001-258860 | 9/2001 |
| JP | 2003-310509 | 11/2003 |
| JP | 2007-160128 | 6/2007 |
| JP | 2015-043788 | 3/2015 |
| KR | 10-2006-0038797 | 5/2006 |
| KR | 10-0738886 | 7/2007 |
| KR | 10-2009-0084227 | 8/2009 |
| KR | 10-2010-0136882 | 12/2010 |
| KR | 10-2011-0026414 | 3/2011 |
| KR | 20-2012-0007096 | 10/2012 |
| KR | 10-2013-0078867 | 7/2013 |
| KR | 10-2015-0048488 | 5/2015 |
| KR | 10-2015-0081767 | 7/2015 |
| KR | 10-2015-0102365 | 9/2015 |
| TW | M476575 U | 4/2014 |

OTHER PUBLICATIONS

International Search Report and Written Opinion dated Jan. 26, 2017 issued in Application No. PCT/KR2016/009677.
Taiwanese Office Action dated Nov. 29, 2017 issued in Application No. 105127920.
Korean Notice of Allowance dated May 3, 2018 issued in Application No. 10-2017-0062515.
Russian Office Action dated Nov. 16, 2018 issued in Application No. 2018111463/12(017803).
European Search Report dated Mar. 19, 2019 issued in Application No. 16842257.4.
Japanese Office Action dated Apr. 23, 2019 issued in Application No. 2018-508144.
Japanese Office Action dated Aug. 20, 2019 issued in JP Application No. 2018-508144.
Korean Notice of Allowance dated Apr. 15, 2021 issued in KR Application No. 10-2017-0033263.
European Notice of Allowance dated Nov. 11, 2022 issued in Application 16842257.4.

* cited by examiner

ROBOT CLEANER

CROSS-REFERENCE TO RELATED PATENT APPLICATIONS

This application is a Continuation of U.S. application Ser. No. 15/749,689, filed Feb. 1, 2018, which is a U.S. National Stage Application under 35 U.S.C. § 371 of PCT Application No. PCT/KR2016/009677, filed Aug. 31, 2016, which claims priority to Korean Patent Application No. 10-2015-0122967, filed Aug. 31, 2015, and Korean Patent Application No. 10-2015-0123430, filed Sep. 1, 2015, whose entire disclosures are hereby incorporated by reference.

TECHNICAL FIELD

The present invention relates to a robot cleaner.

BACKGROUND ART

Generally, a cleaner is a home appliance which suctions and removes foreign substances on a bottom surface. Recently, among such cleaners, a cleaner which automatically performs a cleaning operation is particularly referred to as a robot cleaner. The robot cleaner suctions and removes the foreign substances while being moved by a driving force of a motor which is operated by receiving power from a battery.

In Korean Patent Publication No. 10-2006-0038797 (published on May 4, 2006) as a prior document, there is disclosed a robot cleaner. The robot cleaner includes a suction module which effectively removes foreign substances collected on not only a flat floor but also a recessed portion while being put on the floor. However, according to the robot cleaner of the prior document, since the robot cleaner is operated while being put on the floor, there is a problem that a space other than the floor may not be cleaned. Also, even in the case in which the robot cleaner cleans the floor, when a space of which a height from a floor surface is smaller than a height of the robot cleaner, the robot cleaner may not move to the space, and thus a cleaning area is limited.

DISCLOSURE

Technical Problem

The present invention is directed to providing a robot cleaner which is able to clean not only a floor but also a space other than the floor. Also, the present invention is directed to providing a robot cleaner which is able to replace a suction module to perform a cleaning operation specialized according to a user's requirement. Also, the present invention is directed to providing a robot cleaner which is able to perform a cleaning operation even at a space in which a main body of the robot cleaner may not enter. Also, the present invention is directed to providing a robot cleaner which is able to prevent dust suctioning performance from being degraded when a user manually performs a cleaning operation. Also, the present invention is directed to providing a robot cleaner which is able to be easily moved on a floor when a user manually performs a cleaning operation. Also, the present invention is directed to providing a robot cleaner which is able to be automatically moved following a user's movement when the user manually performs a cleaning operation.

Technical Solution

One aspect of the present invention provides a robot cleaner including a main body having a suction motor; a moving unit configured to automatically move the main body; and a suction module configured to be in communication with the suction motor and to clean a floor, wherein an accommodating portion in which a part of the suction module is accommodated is provided at a lower portion of a front side of the main body, and while the suction module is located in the accommodating portion, a part of the suction module is disposed to be vertically overlapped with the main body, and another part of the suction module protrudes toward both sides from a front portion of the main body, and still another part of the suction module protrudes to a front of the main body.

Advantageous Effects

According to the proposed invention, since the suction module protrudes outside the main body while being installed at the main body, the cleaning operation can be performed at the space in which the main body cannot enter. Also, since the suction module can be replaced according to a user's requirement, the cleaning operation can be effectively performed using a desired suction module. Also, since an additional suction module can be connected to the main body, the cleaning operation can be performed at not only the floor surface but also a space other than the floor surface. Also, in the case of a space in which the robot cleaner cannot enter while the floor is cleaned, the cleaning operation can be performed using an additional suction module connected to the main body.

Also, when the user manually performs the cleaning operation, the suction passage connected to the suction module for cleaning the floor surface can be blocked, and thus the suction force can be applied to only the additional suction module, and dust suction performance can be prevented from being degraded. Also, when the user manually performs the cleaning operation, a connection between the motor and the wheel is released, and thus the robot cleaner can be smoothly moved. Also, when the user manually performs the cleaning operation, the robot cleaner can be automatically moved following the user's movement, and thus the user's cleaning convenience can be enhanced.

MODE FOR INVENTION

Figure 1:
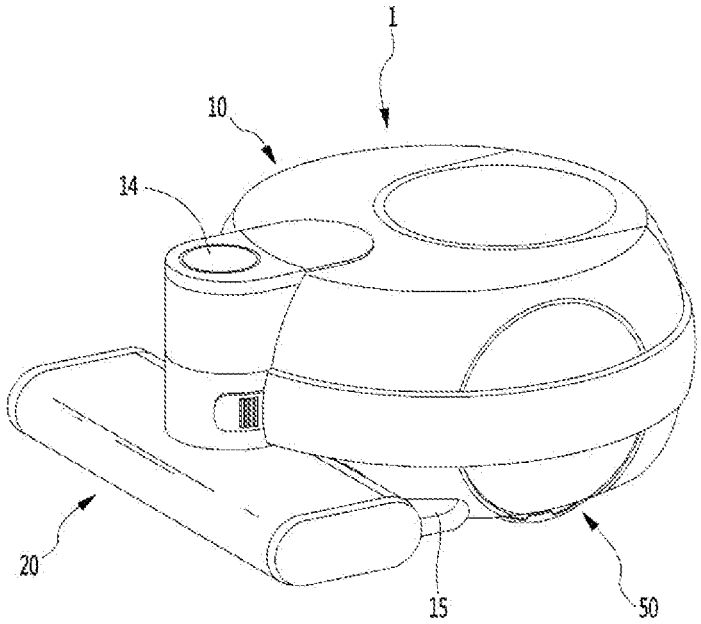
FIG. 1 is a perspective view of a robot cleaner according to a first embodiment of the present invention.

Hereinafter, exemplary embodiments of the present invention will be described in detail. In the drawings, the same components are designated by the same reference numerals, even though they are depicted in different drawings.

It will be understood that, although the terms first, second, A, B, (a), (b) etc. may be used herein to describe various elements, these elements should not be limited by these terms. These terms are only used to distinguish one element from another. It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 2:
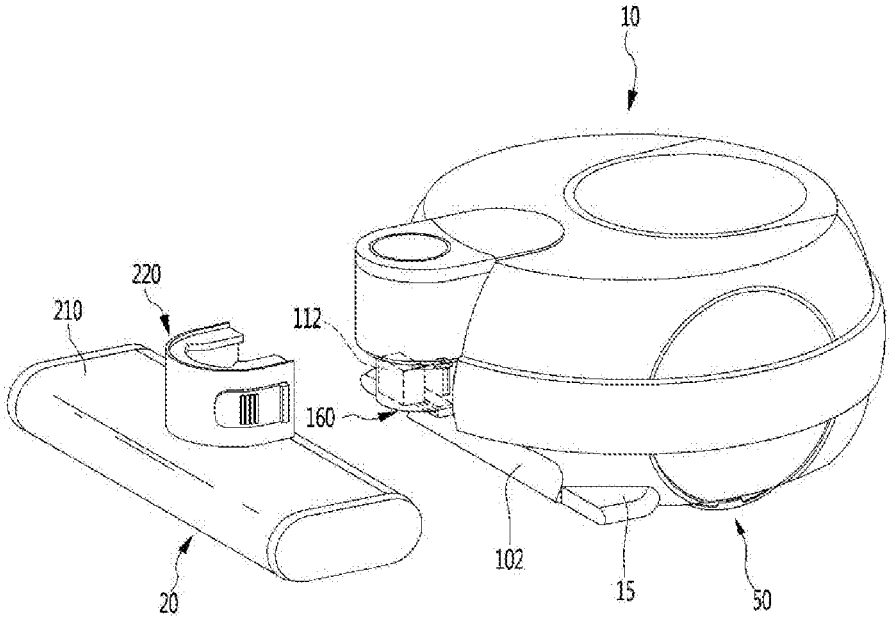
FIG. 2 is view illustrating a state in which a first suction module is separated in FIG. 1.

FIG. 1 is a perspective view of a robot cleaner according to a first embodiment of the present invention, and FIG. 2 is view illustrating a state in which a first suction module is separated in FIG. 1. Referring to FIGS. 1 and 2, a robot cleaner 1 according to a first embodiment of the present invention may include a main body 10 having a suction motor (not shown) which generates a suction force.

The robot cleaner 1 may further include a first suction module 20 (or suction head) which is connected to the main body 10 to clean a floor. The first suction module 20 may be separably connected to the main body 10. A first module connection part (or first connector) 160 to which the first suction module 20 is connected may be provided at the main body 10.

The first module connection part 160 may protrude forward from a front surface of the main body 10. Alternatively, the first module connection part 160 may be recessed backward from the front surface of the main body 10. A horizontal width of the first module connection part 160 is smaller than that of the first suction module 20.

The main body 10 may include an accommodating portion (or accommodating recess) 102 which accommodates at least a part of the first suction module 20 while the first suction module 20 is connected to the first module connection part 160. The first module connection part 160 may be disposed at a front side of the main body 10, but the present invention is not limited thereto. Therefore, the first suction module 20 may be disposed at the front side of the main body 10.

The accommodating portion 102 may be formed by, for example, recessing backward a lower portion of the front surface of the main body 10 in a predetermined depth. For example, the accommodating portion 102 may be located at a lower side of the first module connection part 160.

Therefore, while the first suction module 20 is located at the accommodating portion 102, a part of the first suction module 20 is disposed to be vertically overlapped with the main body 10. For example, a part of the first suction module 20 is disposed to be vertically overlapped with the first module connection part 160 of the main body 10.

Another part of the first suction module 20 protrudes from a front portion of the main body 10 to both sides thereof. For example, another part of the first suction module 20 may protrude to both of left and right sides of the first module connection part 160 of the main body 10. Also, still another part of the first suction module 20 protrudes to a front of the main body 10. That is, still another part of the first suction module 20 is located at a front side further than the first module connection part 160.

The first suction module 20 may include a case 210 having an inlet port, and a main body connection part (or main body connection extension) 220 which is disposed at one side of the case 210. In a state in which the main body connection part 220 of the first suction module 20 is connected to the first module connection part 160, at least a part of the case 210 may protrude outside the main body 10.

Also, at least a part of the inlet port of the first suction module 20 may not be vertically overlapped with the main body 10, and another part thereof may be disposed to be vertically overlapped with the main body 10. In other words, at least a part of the inlet port of the first suction module 20 may be located at an outer area of the main body 10.

When the first module connection part 160 protrudes from the main body 10, the main body connection part 220 may be connected to the first module connection part 160 while surrounding the first module connection part 160. That is, the first module connection part 160 may be accommodated in the main body connection part 220.

The main body 10 may further include a first suction passage 112 through which air and dust suctioned from the first suction module 20 are introduced. The first suction passage 112 may be in communication with the suction motor and may extend to the first module connection part 160.

A height of the case 210 from a floor surface is lower than that of the main body 10. Therefore, in a process in while the robot cleaner 1 cleans the floor, the case 210 of the first suction module 20 may be moved to a space having a height lower than the height of the main body 10 of the robot cleaner 1, and thus a cleanable area of the robot cleaner 1 may be increased.

The first suction module 20 is a module which may clean the floor. Since the first suction module 20 may be separable from the main body 10, a different type suction module from the first suction module 20 may be coupled to the first module connection part 110.

An extension part (or extension) 15 which prevents an obstacle from being inserted into a space between the main body 10 and the first suction module 20 located outside the main body 10 may be provided at the main body 10. The extension part 15 may be located between a rear surface of the first suction module 20 and an outer circumferential surface of the main body 10, but the present invention is not limited thereto.

Also, when the first suction module 20 is connected to the main body 10, the extension part 15 may be in contact with the rear surface of the first suction module 20. Meanwhile, the robot cleaner 1 may further include a moving unit 50 for moving the main body 10, and an input part (or input device) 14 through which various commands are input. Also, although not illustrated, the main body 10 may further include an obstacle detecting sensor which allows the main body 10 to be moved while avoiding an obstacle.

The moving unit 50 may include a wheel and a motor for rotating the wheel so that the robot cleaner 1 is automatically moved. The motor may be directly connected to the wheel or may be connected to the wheel via a power transmission part. For example, the moving unit 50 may include one pair of wheels and one pair of motors for independently driving each of the pair of wheels.

In the above description, it has been described that the first suction module 20 is separably connected to the main body 10. Instead, the first suction module 20 may be maintained in a fixed state to the main body 10.

The main body 10 may further include a filter (not shown) which filters dust from air suctioned through the suction motor, and a dust container (not shown) which stores the dust separated from the air. The main body 10 may further include a controller which controls an operation of the cleaner.

Figure 3:
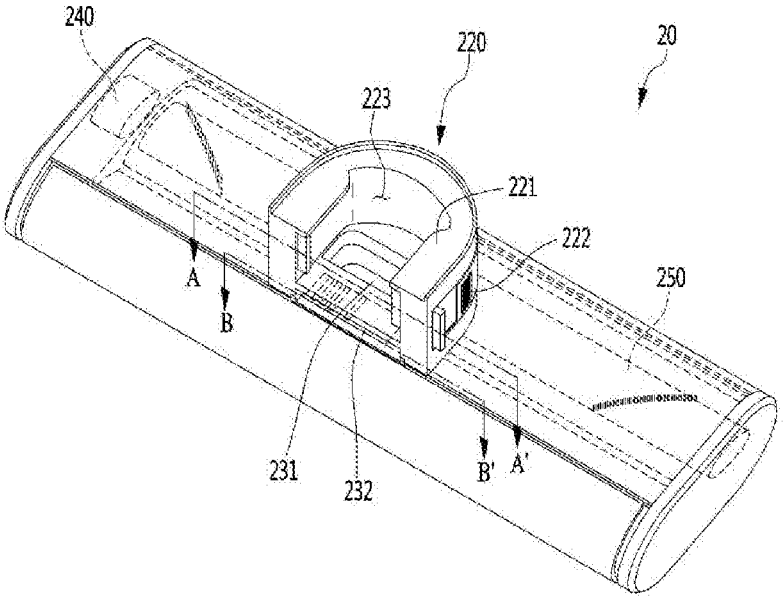
FIG. 3 is a perspective view of the first suction module according to the first embodiment of the present invention.
Figure 4:
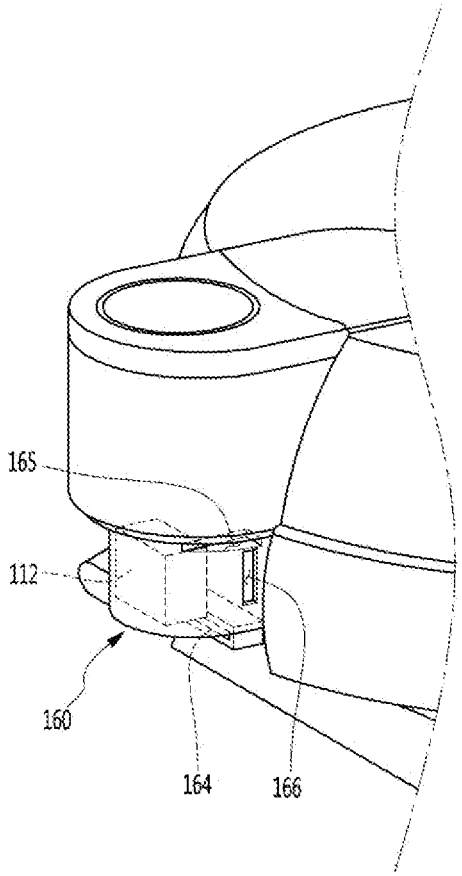
FIG. 4 is a partial perspective view of a main body according to the first embodiment of the present invention.
Figure 5:
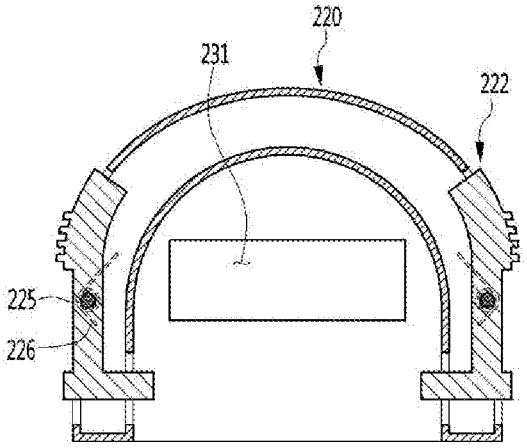
FIG. 5 is a cross-sectional view taken along line A-A of FIG. 4.
Figure 6:
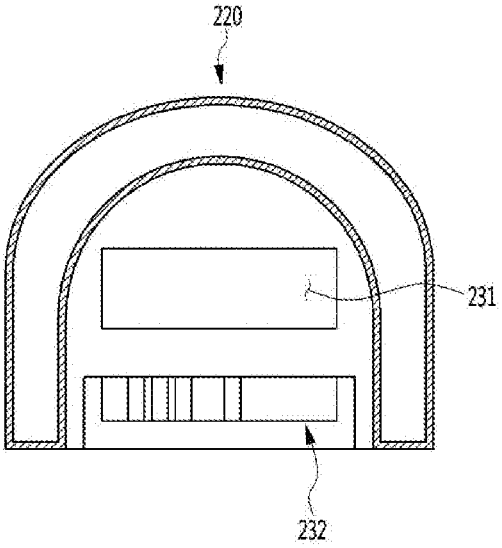
FIG. 6 is a cross-sectional view taken along line B-B of FIG. 4.

FIG. 3 is a perspective view of the first suction module according to the first embodiment of the present invention, FIG. 4 is a partial perspective view of a main body according to the first embodiment of the present invention, FIG. 5 is a cross-sectional view taken along line A-A of FIG. 4, and FIG. 6 is a cross-sectional view taken along line B-B of FIG. 4. Referring to FIGS. 2 to 6, the case 210 of the first suction module 20 may be semitransparent, but the present invention is not limited thereto. One surface of the case 210 may be selectively opened and closed, and maintenance of an internal configuration of the case may be allowed through the opened and closed one surface.

The main body connection part 220 may be located on an upper surface of the case 210. For example, the main body connection part 220 may be located at a center of the upper surface of the case 210. A width of the main body connection part 220 is formed smaller than a horizontal width of the case 210.

While the main body connection part 220 is coupled to the first module connection part 160, a part of the first module connection part 160 may be accommodated in the main body connection part 220. That is, the main body connection part 220 may include an accommodating portion 223 in which a part of the first module connection part 160 is accommodated.

The main body connection part 220 may include a rib 221 and an operating part (or latch) 222 for being fastened to the case 210 of the main body 10. The rib 221 may guide coupling of the first suction module 20 and the main body 10, and the operating part (or latch) 222 may fix the main body connection part 220 to the first module connection part 160.

The rib 221 may protrude from an inn surface of the main body connection part 220. To stably couple the main body connection part 220 with the first module connection part 160, a plurality of ribs 221 may protrude from the main body connection part 220.

The plurality of ribs 221 are disposed to be spaced apart from each other, and a part of the first module connection part 160 may be located between the plurality of ribs 221 when the main body connection part 220 and the first module connection part 160 are coupled to each other. The rib 221 is slid along a rib groove 165 provided at an outer circumferential surface of the first module connection part 160 when the main body connection part 220 and the first module connection part 160 are coupled to each other.

As illustrated in the drawing, the rib 221 may be formed to extend inward from an uppermost end of the main body connection part 220, but the present invention is not limited thereto. The rib 221 may be located at any portions of the main body connection part 220, as long as the main body connection part 220 may be prevented from being vertically moved and the coupling between the first suction module 20 and the first module connection part 160 may be guided.

Also, the embodiment has described that the rib 221 is provided at the main body connection part 220 and the rib groove 165 is provided at the first module connection part 160, but the present invention is not limited thereto. The rib 221 may be provided at the first module connection part 160, and the rib groove 165 may be provided at the main body connection part 220. In the specification, one of the rib 221 and the rib groove 165 may be referred to as a first guide portion (or first guide surface), and the other one may be referred to as a second guide portion (or second guide surface).

A plurality of operating parts 222 may be provided at the main body connection part 220, and one side of each of the operating parts 222 may be exposed to an outer circumferential surface of the main body connection part 220 to be pressed by a user. Also, a protrusion which passes through the main body connection part 220 and protrudes inside the main body connection part 220 is provided at the other side of each of the operating parts 222.

Each of the operating parts 222 may include a rotating shaft 225 which rotatably fixes the operating part 222, and an elastic member 226 which is fixed to the rotating shaft 225 to return the operating part 222 to an original position. When one side of the operating part 222 is operated by the user, the operating part 222 is rotated at a predetermined angle and moved to a position which is deviated from the accommodating portion 223 of the main body connection part 220. On the contrary, when the user's external force is released from one end of the operating part 222, the elastic member 226 may return the operating part 222 to the original position. That is, the protrusion deviated from the accommodating portion 223 of the main body connection part 220 may protrude to the accommodating portion 223.

As the protrusion protrudes to the accommodating portion 223 and is accommodated in an operating part fastening groove 166 of the first module connection part 160 while the first module connection part 160 is accommodated in the accommodating portion 223 of the main body connection part 220, the main body connection part 220 and the first module connection part 160 may be coupled to each other.

Also, the embodiment has described that the operating part 222 is provided at the main body connection part 220 and the operating part fastening groove 165 is provided at the first module connection part 160, but the present invention is not limited thereto. The operating part 222 may be provided at the first module connection part 160 and the operating part fastening groove 166 may be provided at the main body connection part 220. In the specification, one of the operating part 222 and the operating part fastening groove 166 may be referred to as a first fastening portion, and the other one may be referred to as a second fastening portion.

The first suction module 20 may further include a discharge hole 231 trough which the air and the dust are discharged. When the main body connection part 220 is coupled to the first module connection part 160, the discharge hole 231 may be in communication with the suction passage 112. Therefore, the air and the dust discharged through the discharge hole 231 may be introduced into the main body 10 through the suction passage 112. Also, the first suction module 20 may further include a connector 232 which is electrically connected to a connector accommodating portion 164 of the main body 10.

The first suction module 20 may further include a rotating cleaning member 250 which is rotated inside the case 210. The rotating cleaning member 250 may be located at the inlet port and may sweep up the dust on the floor surface. The rotating cleaning member 250 may include a cylindrical body, and a spiral brush may be arranged at the body.

The first suction module 20 may further include a rotating motor 240 for rotating the rotating cleaning member 250. When the connector 232 is coupled to the connector accommodating portion 164 provided at the first module connection part 160, the rotating motor 240 may receive a control signal from a controller of the main body 10 and may be operated by receiving power from the main body 10.

The embodiment has described that the rotating motor 240 is located at one side of the rotating cleaning member 250, but the rotating motor 240 may be located inside the rotating cleaning member 250. When the rotating motor 240 is provided inside the rotating cleaning member 250, it is not necessary to provide a separate space for the rotating motor 240, and thus the rotating cleaning member 250 may extend long in a transverse direction.

Also, one of the connector 232 and the connector accommodating portion 164 may be referred to as a first connector, and the other one may be referred to as a second connector. A rotating speed and a rotating direction of the rotating motor 240 may be changed according to a type of the floor surface.

Figure 7:
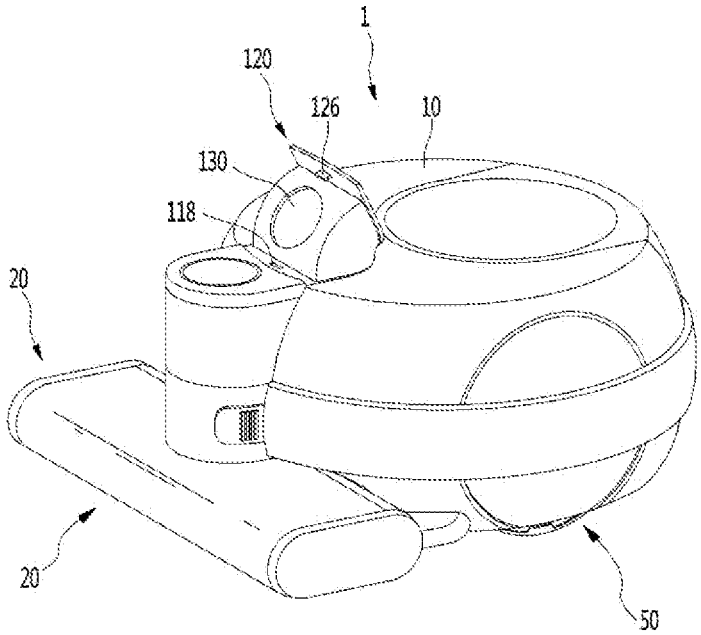
FIG. 7 is a view illustrating a second module connection part according to the first embodiment of the present invention.
Figure 8:
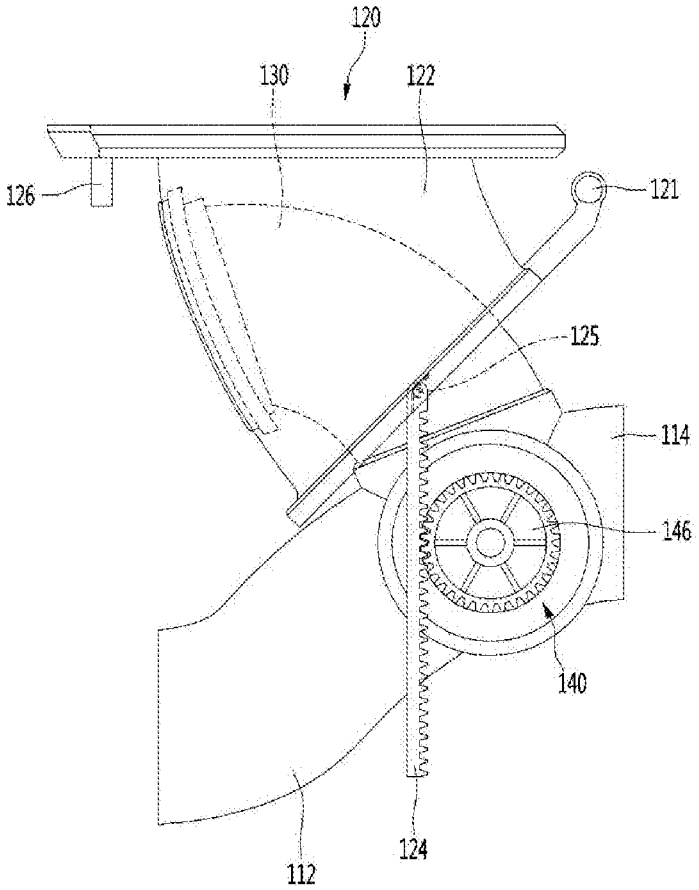
FIG. 8 is a view illustrating a state in which the second module connection part of FIG. 7 is located at a first position of the main body.
Figure 9:
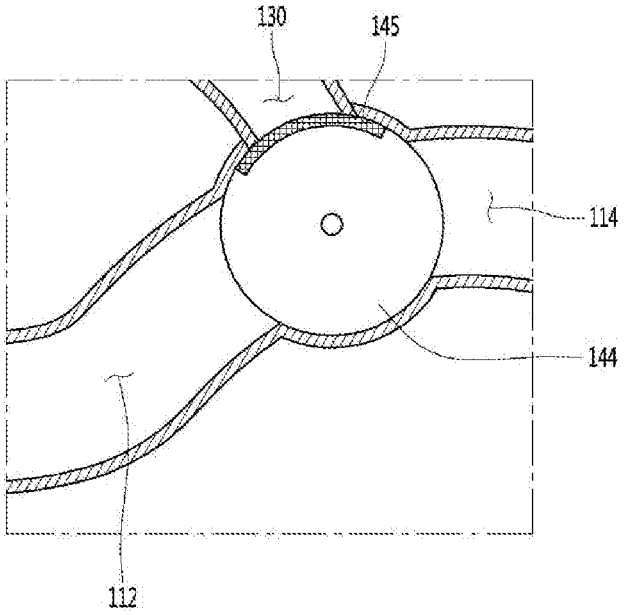
FIG. 9 is a view illustrating a passage in the main body in the state in which the second module connection part of FIG. 7 is located at the first position of the main body.
Figure 10:
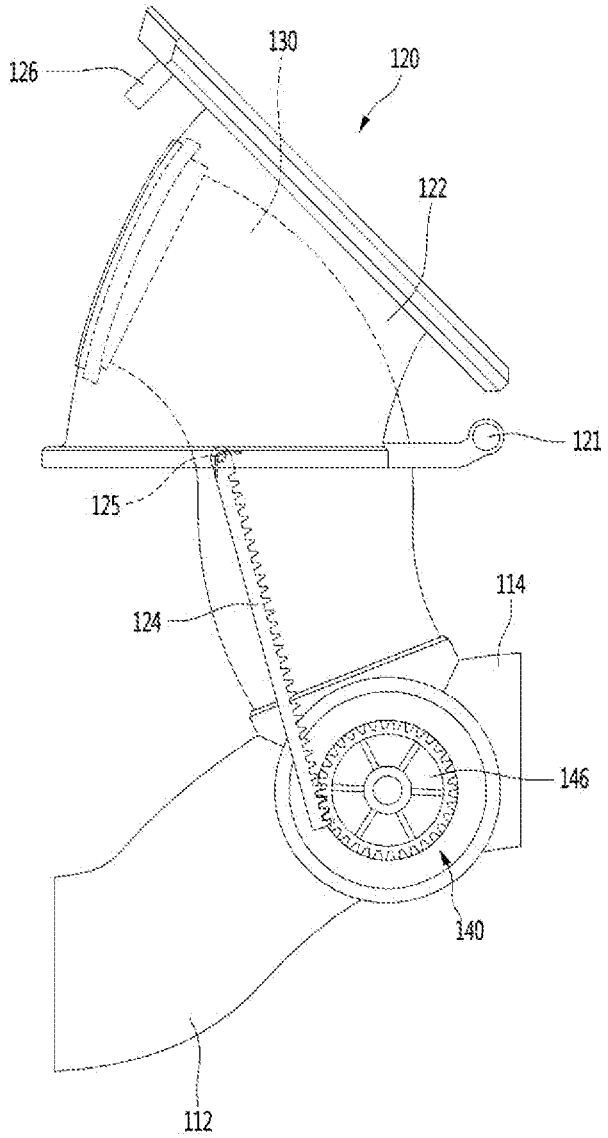
FIG. 10 is a view illustrating a state in which the second module connection part of FIG. 7 is located at a second position of the main body.
Figure 11:
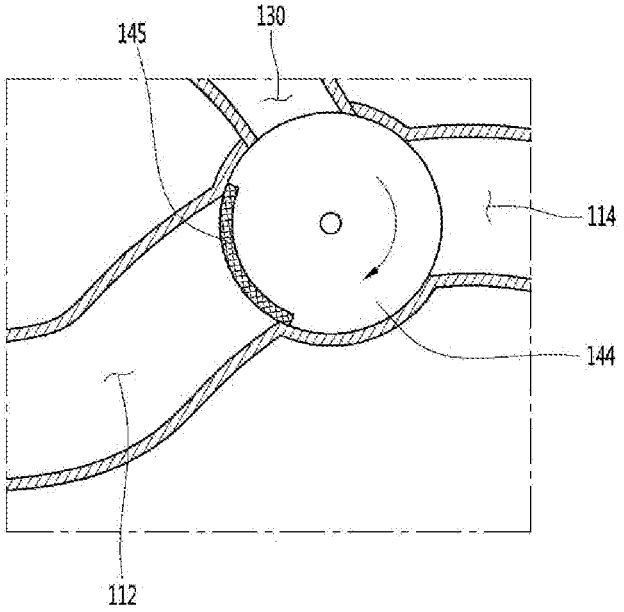
FIG. 11 is a view illustrating a passage in the main body in the state in which the second module connection part of FIG. 10 is located at the second position of the main body.
Figure 12:
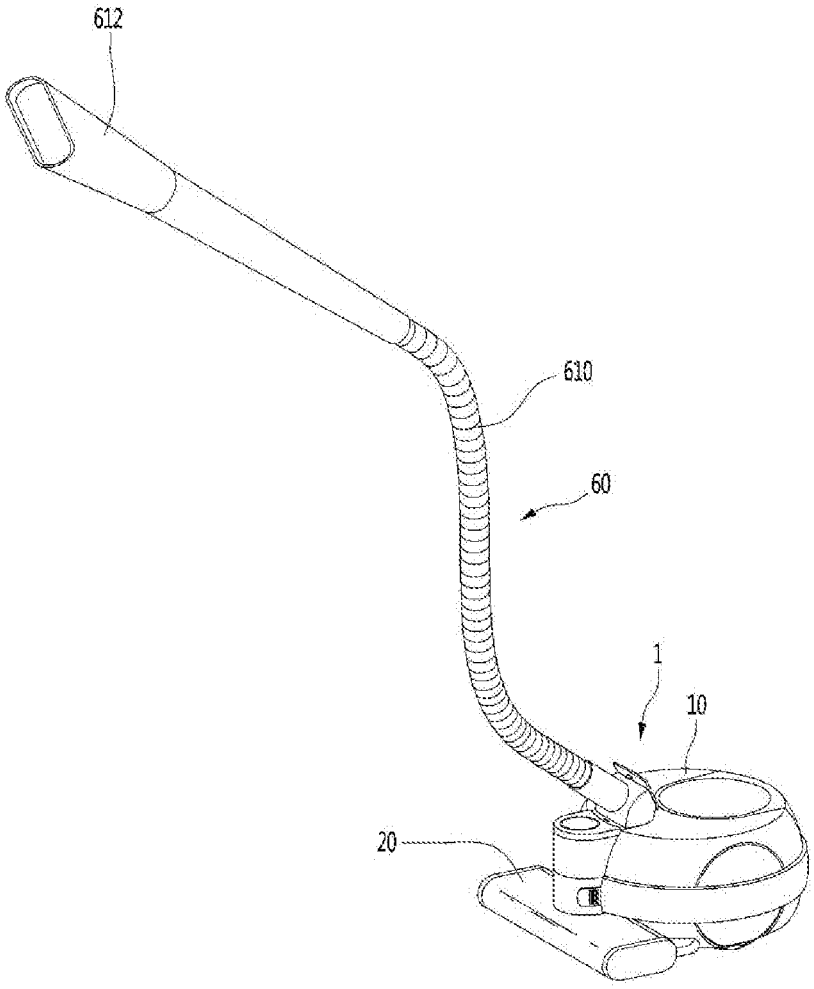
FIG. 12 is a view illustrating a state in which a second suction module is connected to the second module connection part.

FIG. 7 is a view illustrating a second module connection part according to the first embodiment of the present invention, FIG. 8 is a view illustrating a state in which the second module connection part of FIG. 7 is located at a first position of the main body, and FIG. 9 is a view illustrating a passage in the main body in the state in which the second module connection part of FIG. 7 is located at the first position of the main body. FIG. 10 is a view illustrating a state in which the second module connection part of FIG. 7 is located at a second position of the main body, FIG. 11 is a view illustrating a passage in the main body in the state in which the second module connection part of FIG. 10 is located at the second position of the main body, and FIG. 12 is a view illustrating a state in which a second suction module is connected to the second module connection part. Referring to FIGS. 7 to 12, the main body 10 may further include a second module connection part (or second connector) 120 to which a second suction module 60 (or hose) is connected.

The second module connection part 120 may be moved between a first position and a second position in the main body 10. At this point, the first position is a position at which the second module connection part 120 is moved where the second suction module 60 is not connected, and the second position is a position at which the second module connection part 120 is moved where the second suction module 60 is connectable.

The second module connection part 120 may be provided at the main body 10 to be rotatable about a hinge 121, but the present invention is not limited thereto. Also, the second module connection part 120 may protrude outside the main body 10 in a moved stated to the second position.

The main body 10 may further include a second suction passage 130. Also, the main body 10 may further include a common passage 114 which may be in communication with the first suction passage 112 and the second suction passage 130. For example, the second suction passage 130 may be formed of a flexible material.

The second module connection part 120 may further include a connection body 122 to which the second suction passage 130 is connected. The connection body 122 may be rotatably connected to the main body 10 and may protrude outside the main body 10. Since the second suction passage 130 is connected to the connection body 122, the second suction passage 130 may also protrude outside the main body 10 when the connection body 122 protrudes outside the main body 10. In other words, in the present invention, the second suction passage 130 is selectively exposed outside the main body 10. The second suction module 60 may be directly or indirectly connected to the second suction passage 130 which protrudes outside the main body 10.

The second module connection part 120 may be manually rotated by the user or may be automatically rotated by driving of a motor. When the second module connection part 120 is automatically rotated, a command for rotating the second module connection part 120 may be input through the input part 14, and thus the second module connection part 120 may be automatically rotated by the motor. Of course, a command for returning the second module connection part 120 to an original position may also be input through the input part 14.

Alternatively, when the second suction module 60 is not connected to the second module connection part 120 for a predetermined time while the second module connection part 120 is rotated, the second module connection part 120 may be automatically returned to the original position.

A first fastening portion 118 is provided at the main body 10 and a second fastening portion 126 to which the first fastening portion 118 is fastened may be provided at the second module connection part 120 so that the second module connection part 120 is fixed to the main body 10 in the moved state to the first position when the second module connection part 120 is manually rotated.

When the second module connection part 120 is pushed while the first fastening portion 118 is fastened to the second fastening portion 126, the fastening between the first fastening portion 118 and the second fastening portion 126 may be released, but the present invention is not limited thereto. And when the second module connection part 120 is pushed while the fastening between the first fastening portion 118 and the second fastening portion 126 is released, the first fastening portion 118 and the second fastening portion 126 may be fastened to each other.

The main body 10 may further include a passage switching unit (or switch) 140 which allows one of the first suction passage 112 and the second suction passage 130 to be selectively in communication with the common passage 114. The passage switching unit 140 may be interlocked with the second module connection part 120, but the present invention is not limited thereto. For example, the passage switching unit 140 may be operated by receiving a rotating force of the second module connection part 120.

The passage switching unit 140 may include a switching part 144 which is located on the common passage 114. The switching part 144 may be rotated in the common passage 114. The switching part 144 may include a shielding member 145 for shielding one of the first suction passage 112 and the second suction passage 130 while being rotated.

The passage switching unit 140 may further include a first transmission part 124 which is connected to the second module connection part 120 and a second transmission part 146 which is connected to the switching part 144. The first transmission part 124 may be a rack gear which is rotatably connected to the connection body 122. The second transmission part 146 may be a pinion gear which is engaged with the rack gear.

The passage switching unit 140 may further include an elastic member 125 which allows the first transmission part 124 and the second transmission part 146 to be maintained in a connected state to each other while the second module connection part 120 is rotated. The elastic member 125 may provide a rotating force to the first transmission part 124 so that the first transmission part 124 is rotated about a rotating center of the first transmission part 124 in a counterclockwise direction based on FIG. 8.

As another example, the passage switching unit 140 may transmit a rotating force of the second module connection part 120 to the switching part 144 using a plurality of pinion gears. Referring to FIGS. 8 and 10, while the second module connection part 120 is moved to the first position, the shielding member 145 of the switching part 144 shields the second suction passage 130. In other words, the shielding member 145 of the switching part 144 shields a communication state between the second suction passage 130 and the common passage 114. In this state, the common passage 114 is in communication with the first suction passage 112. Therefore, the air and the dust suctioned through the first suction module 20 may pass through the first suction passage 112 and may flow to the common passage 114.

On the other hand, referring to FIGS. 9 and 11, while the second module connection part 120 is moved to the second position, the switching part 144 receives the rotating force of the second module connection part 120 and is rotated in a clockwise direction on the drawing, and thus the shielding member 145 of the switching part 144 shields the first suction passage 112. In other words, the shielding member 145 of the switching part 144 blocks a communication state between the first suction passage 112 and the common passage 114. In this state, the common passage 114 is in communication with the second suction passage 130. In such a state, the user may connect the second suction module 60 with the second module connection part 120, as illustrated in FIG. 12.

In order to smoothly clean a space other than the floor surface using the second suction module 60, the second suction module 60 may include a suction part 612, and a suction hose 610 which is formed of a flexible material to allow the suction part 612 to be in communication with the second module connection part 120.

While the second suction module 60 is connected to the second module connection part 120, a suction force of the suction motor may act on the second suction module 60. Therefore, the air and the dust suctioned through the second suction module 60 passes through the second suction passage 130 and flows to the common passage 114. According to the proposed invention, since the second suction module as an additional suction module may be connected to the main body, not only the floor surface but also the space other than the floor surface may be cleaned.

Also, even in the case of a space in which the robot cleaner may not enter during a floor cleaning operation, the space may be cleaned using the additional suction module connected to the main body. Also, when a cleaning operation is performed using the first suction module or the second suction module, one of the two suction passages is blocked, and thus the suction force is prevented from being distributed to the two suction passages, and dust suction performance is also prevented from being degraded.

Figure 13:
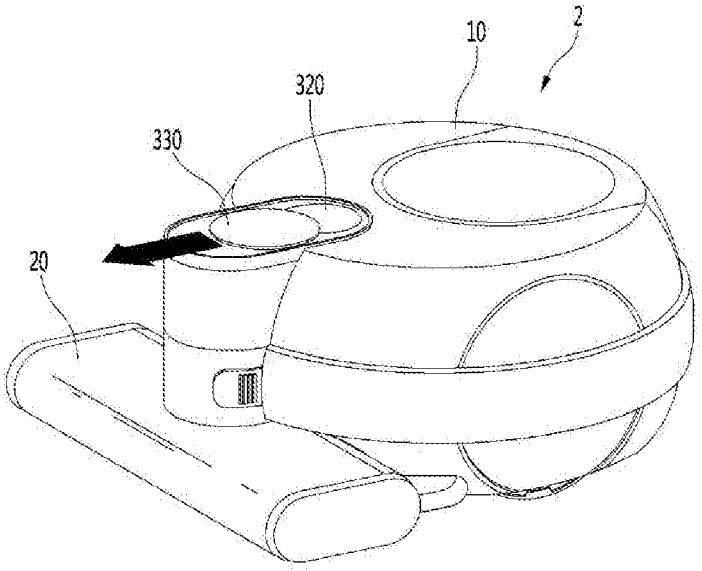
FIG. 13 is a view illustrating a second module connection part according to a second embodiment of the present invention.
Figure 14:
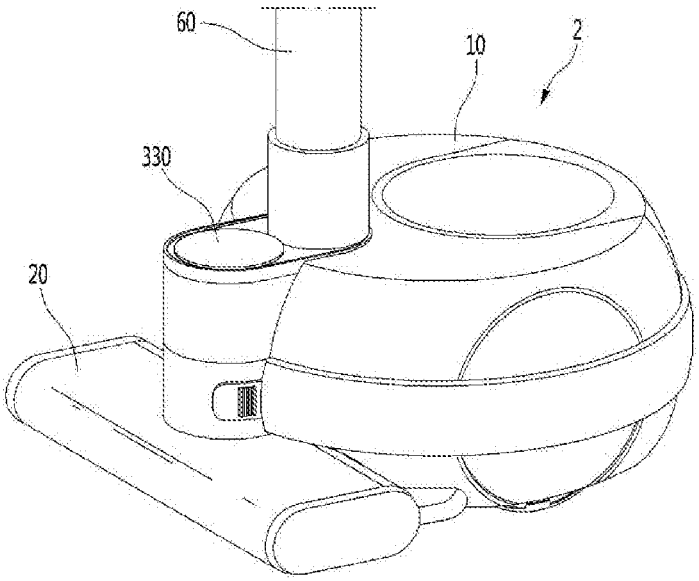
FIG. 14 is a view illustrating a state in which the second suction module is connected to the second module connection part of FIG. 13.

FIG. 13 is a view illustrating a second module connection part according to a second embodiment of the present invention, and FIG. 14 is a view illustrating a state in which the second suction module is connected to the second module connection part of FIG. 13. Referring to FIGS. 13 and 14, a main body 10 of a robot cleaner 2 according to a second embodiment of the present invention may include a second module connection part 320 to which the second suction module 60 is connected.

Also, the main body 10 may further include an opening and closing member (or cover) 330 for opening and closing the second module connection part 320. For example, the opening and closing member 330 may be slidably or rotatably coupled to the main body 10. While the opening and closing member 330 closes the second module connection part 320, a foreign substance may be prevented from being introduced into the second module connection part 320.

The main body 10 may include the passage switching unit described in the first embodiment. However, a switching part of the passage switching unit of the embodiment may receive a moving force of the opening and closing member 330. The opening and closing member 330 may be manually operated by the user or may be automatically operated by receiving a rotating force of a motor. In the embodiment, since the second module connection part 320 maintains a fixed state to the main body 10, a structure of the second module connection part 320 is simplified.

Figure 15:
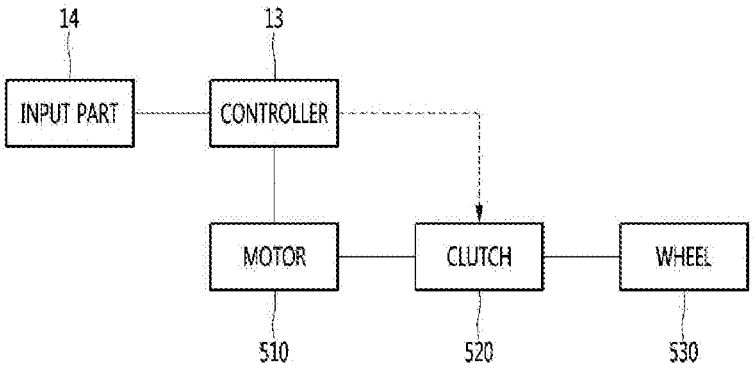
FIG. 15 is a block diagram of a robot cleaner according to a third embodiment of the present invention.

FIG. 15 is a block diagram of a robot cleaner according to a third embodiment of the present invention. A robot cleaner according to a third embodiment of the present invention has the same structure as that in the first embodiment or the second embodiment. However, the embodiment is different from the first embodiment or the second embodiment in a moving unit for automatically moving the robot cleaner. Therefore, hereinafter, only a characteristic portion of the embodiment will be described.

Referring to FIGS. 1, 12 and 15, a robot cleaner 1 according to a third embodiment of the present invention may include a motor 510 which generates a driving force for automatically moving a main body, and a wheel 530 which is rotated by the motor 510. The robot cleaner 1 may further include a controller 13 for controlling the motor 510, and an input part 14 for inputting various commands. Also, the robot cleaner 1 may further include a clutch 520 which blocks a driving force of the motor 510 from being transmitted to the wheel 530.

An automatic cleaning mode and a manual cleaning mode may be selected using the input part 14. The automatic cleaning mode is a mode in which the robot cleaner 1 performs a cleaning operation while automatically traveling. In the automatic cleaning mode, the air and the dust may be suctioned through the first suction module 20. The manual cleaning mode is a mode in which the cleaning operation is manually performed in a state in which the user connects the second suction module 60 to the robot cleaner 1.

In the automatic cleaning mode of the present embodiment, the controller 13 controls the clutch 520 so that the driving force of the motor 510 is transmitted to the wheel 530. In other words, in the automatic cleaning mode, the clutch 520 connects the motor 510 with the wheel 530.

However, in the manual cleaning mode, the robot cleaner may be freely moved by the user. In the manual cleaning mode, the controller 13 controls the clutch 520 so that a connection between the motor 510 and the wheel 530 is released and the robot cleaner is manually smoothly moved.

In a state in which the connection between the motor 510 and the wheel 530 is released, the wheel 530 is in an idle state with respect to the motor 510. Therefore, in a state in which the motor 510 is stopped, the robot cleaner 1 is manually movable through the wheel 530 while being put on the floor. At this point, while the robot cleaner 1 is stopped, the state in which the connection between the motor 510 and the wheel 530 is released may be maintained.

Figure 16:
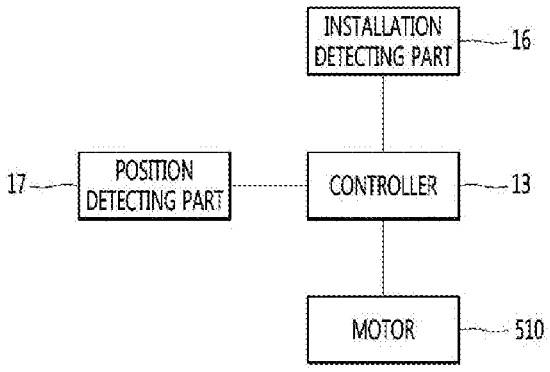
FIG. 16 is a block diagram of a robot cleaner according to a fourth embodiment of the present invention.

FIG. 16 is a block diagram of a robot cleaner according to a fourth embodiment of the present invention. A robot cleaner according to a fourth embodiment of the present invention has the same structure as that in the first embodiment or the second embodiment. However, the embodiment is different from the first embodiment or the second embodiment in a moving unit for automatically moving the robot cleaner. Therefore, hereinafter, only a characteristic portion of the embodiment will be described.

Referring to FIGS. 12 and 16, a robot cleaner according to a fourth embodiment of the present invention may include a motor 510 for automatically moving the robot cleaner, and a controller 13 for controlling the motor 510. Also, the robot cleaner may further include an installation detecting part 16 for detecting an installation of the second suction module 60.

The controller 13 may control the motor 510 based on whether the installation of the second suction module 60 is detected by the installation detecting part 16. When a command for operating the suction motor is input while the installation detecting part 16 detects a fact that the second suction module 60 is not yet installed, the controller 510 may control the motor 510 so that the robot cleaner 1 is moved in a preset traveling pattern. The preset traveling pattern may include various patterns such as a random pattern and a zigzag pattern.

When the command for operating the suction motor is input while the installation detecting part 16 detects a fact that the second suction module 60 is installed, the controller 13 may control the motor 510 so that the robot cleaner 1 is moved following a user's movement. In other words, the controller 13 may control the motor 510 so that the robot cleaner 1 is moved following movement of the second suction module 60.

To this end, the robot cleaner 1 may further include a position detecting part (or sensor) 17 for detecting a user's position or a position of the second suction module 60. The position detecting part 17 may include an ultrasonic transmitting part which is provided at the second suction module 60, and a plurality of ultrasonic receiving parts which are provided at a main body of the robot cleaner 1, but the present invention is not limited thereto.

The controller 13 may determine a position of the ultrasonic transmitting part based on an ultrasonic wave received by the ultrasonic receiving part and may operate the motor 510 when the main body 10 is required to be moved toward the ultrasonic transmitting part of which the position is determined. For example, when the ultrasonic transmitting part is disposed at the second suction module 60, the ultrasonic transmitting part is moved along with the second suction module 60 while the cleaning operation is performed using the second suction module 60. In this case, a distance between the ultrasonic transmitting part and the main body 10 is varied.

A movable distance of the second suction module 60 corresponds to a length of the suction hose 610. When the ultrasonic transmitting part is distant from the main body 10 of the robot cleaner 1 in a certain distance, the controller 13 may control the motor 510 so that robot cleaner 1 is moved toward the ultrasonic transmitting part.

In the present embodiment, a structure of the position detecting part 17 is not limited and may be realized in various types. As another example, the automatic cleaning mode and the manual cleaning mode may be selected through the input part 14.

In the automatic cleaning mode, the controller 13 may control the motor 510 so that the robot cleaner 1 is moved in the preset traveling pattern. In the manual cleaning mode, the controller 13 may control the motor 510 so that the robot cleaner 1 is moved following the user's movement.

In this case, the installation detecting part 16 may be removed from the main body 10. According to the embodiment, when the user manually performs the cleaning operation using the second suction module, the robot cleaner 1 may be automatically moved following the user's movement, and thus user's cleaning convenience is enhanced.

Figure 17:
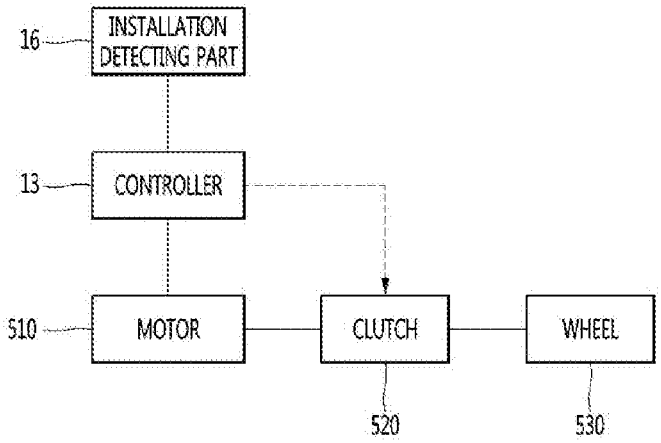
FIG. 17 is a block diagram of a robot cleaner according to a fifth embodiment of the present invention.

FIG. 17 is a block diagram of a robot cleaner according to a fifth embodiment of the present invention. Referring to FIGS. 12 and 17, a robot cleaner according to a fifth embodiment of the present invention may include a motor 510 for automatically moving the robot cleaner, a wheel 530 which is rotated by the motor 510, and a controller 13 for controlling the motor 510.

Also, the robot cleaner may further include a clutch 520 which connects the motor 510 with the wheel 530 or releases a connection therebetween. Also, the robot cleaner may further include an installation detecting part 16 for detecting an installation of the second suction module 60. The controller 510 may control the clutch 520 based on whether the installation of the second suction module 60 is detected by the installation detecting part 16.

When a command for operating the suction motor is input while the installation detecting part 16 detects a fact that the second suction module 60 is not yet installed, the controller 13 may control the clutch 520 so that the motor 510 is connected to the wheel 530. When the command for operating the suction motor is input while the installation detecting part 16 detects a fact that the second suction module 60 is installed, the controller 13 may control the clutch 520 so that the connection between the motor 510 and the wheel 530 is released.

Figure 18:
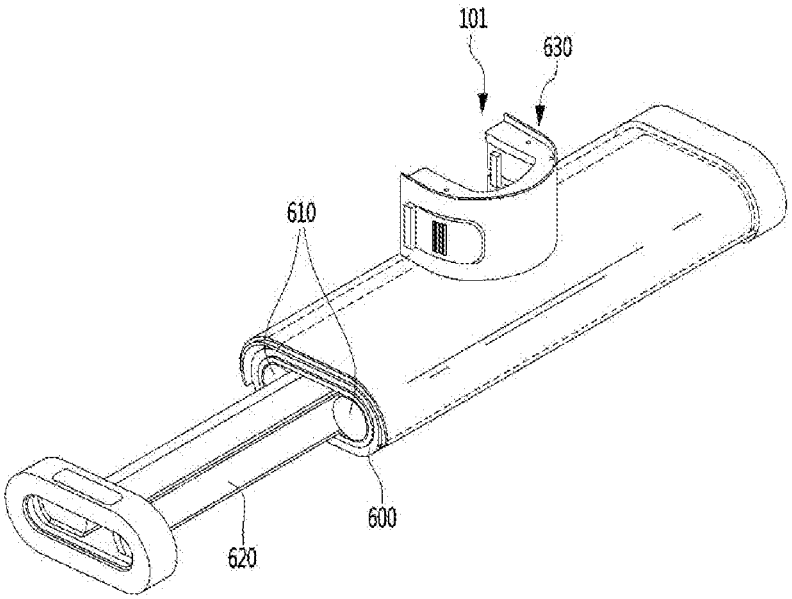
FIG. 18 is a perspective view of a robot cleaner according to a sixth embodiment of the present invention.

FIG. 18 is a perspective view of a robot cleaner according to a sixth embodiment of the present invention. Referring to FIGS. 1 and 18, a first suction module 101 of the present embodiment may be functionally distinguished from the first suction module 20 of the first embodiment, and the first suction module 101 of the present embodiment may be connected to the main body 10 after the suction module 20 of the first embodiment is separated from the main body 10.

The first suction module 101 may include a main body connection part 630. Therefore, the first suction module 101 may be separably coupled to the first module connection part 160. Therefore, detailed description of the main body connection part 630 will be omitted. Hereinafter, only a characteristic portion of the first suction module 101 will be described.

The first suction module 101 of the present embodiment may include a rotating floor-cloth 600, a roller 610 and a water supply container 620. The rotating floor-cloth 600 is a belt type floor-cloth having a wide width which cleans the foreign substance on the floor surface while being rotated. A plurality of rollers 610 may be provided to support the rotating floor-cloth 600 at both sides thereof and to allow the rotating floor-cloth to be rotated. A part of an outer circumferential surface of the rotating floor-cloth 600 is exposed outside the first suction module 101 to be in contact with the floor surface.

In the present embodiment, an area of the rotating floor-cloth 600 which is in contact with the floor surface may be referred to as a cleaning area. The roller 610 may further include a motor. When the motor is provided, the motor may be controlled by the controller and may rotate the rotating floor-cloth 600 supported by the roller 610.

The water supply container 620 is disposed between the plurality of rollers 610 and may include a water inlet part (not shown) through which the user supplies water, and a water outlet part (not shown) through which a predetermined amount of water is discharged. The water outlet part serves to discharge the predetermined amount of water toward an inner surface of the rotating floor-cloth 600, such that the rotating floor-cloth 600 is maintained in a constantly wetted state.

In the first suction module 101, for example, a side surface of a case may be opened and closed, and the rotating floor-cloth 600 and the water supply container 620 may be inserted and withdrawn through the opened side surface. When the rotating floor-cloth 600 gets dirty and thus has to be replaced, or when it is necessary to supply water into the water supply container 620, the user may open the side surface of the case and may replace the rotating floor-cloth 600 or may supply the water into the water supply container 620.

According to the first suction module 101 of the present embodiment, since the belt type floor-cloth may be installed, the floor-cloth having a relatively wide area may be used, and the water contained in the floor-cloth 600 may not be dried by the water supply container 620 and may continuously perform the cleaning operation for a long time.

Also, when the roller 610 includes the motor, wiping may be performed using a rotating force of the motor, and thus the cleaning operation may be performed more cleanly. One of a plurality of first suction modules 20 and 101 having functions different from each other may be coupled to and used in the main body 10 of the present invention. For example, when it is intended to remove the dust on the floor surface, the first suction module 20 including a rotating cleaning member 250 may be coupled to and used in the main body 10.

On the other hand, when the floor surface is cleaned using the floor-cloth, the first suction module 101 having the rotating floor-cloth 600 may be coupled to and used in the main body 10. Therefore, according to the present invention, since the first suction modules 20 and 101 may be replaced according to a cleaning condition, the cleaning operation corresponding to a user's requirement or a condition of the floor surface may be performed.

The above-described embodiment has described that the robot cleaner includes the second module connection part. However, the robot cleaner may include only the first module connection part. Although a few embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. A robot cleaner comprising: a main body accommodating a suction motor configured to generate a suction force; a wheel configured to rotate to automatically move the main body along a floor; and a suction head configured to clean the floor based on the suction force when in communication with the suction motor, wherein the main body includes: a first connector to which the suction head is coupled; an accommodating recess provided at a front of the main body, wherein when the suction head is coupled to the first connector, a portion of the suction head is received in the accommodating recess such that a first part of the suction head vertically overlaps a portion of the main body, and a second part of the suction head protrudes from sides and front of the main body; a second connector to which a hose is selectively coupled, and a second suction passage which is in communication with the hose when coupled to the second connector, wherein the second connector includes a connection body to which the second suction passage is connected, wherein the connection body is movably connected to the main body such that the second connector is movable between a first position and a second position, wherein when the connection body is moved to the first position, the second connection passage is substantially received in the main body, and when the connection body is moved to the second position, at least a portion of the second connection passage protrudes from the main body, wherein when the connection body is moved to the first position, the main body prevents the second connector from being connected to the hose, and wherein when the connection body is moved to the second position, the second connector is positioned to be connectable to the hose.

2. The robot cleaner of claim 1, wherein the suction head is separably installed at the first connector, and the first connector is provided at the front of the main body.

3. The robot cleaner of claim 2, wherein the accommodating recess is located under the first connector.

4. The robot cleaner of claim 2, wherein the suction head includes a first fastening portion, the first connector includes a second fastening portion which is configured to be coupled to the first fastening portion, the first fastening portion includes one of a latch operated by a user or a groove in which a part of the latch is accommodated to couple the first fastener and the second fastener, and the second fastening portion is another one of the latch or the groove.

5. The robot cleaner of claim 2, wherein the suction head includes:

a case which forms an exterior of the suction head; and a main body connection extension which is disposed at an upper side of the case and connected to the first connector, and when the main body connection extension is coupled to the first connector, a height of a top of the case is less than a height of a top of the main body.

6. The robot cleaner of claim 1, wherein the main body further includes:

a common passage which is in communication with the suction motor, a first suction passage which is in communication with the suction head, and a passage switch which allows one of the first suction passage or the second suction passage to be in communication with the common passage.

7. The robot cleaner of claim 6, wherein the passage switch enables the first suction passage to be in communication with the common passage when the hose is separated from the second connector, and enables the second suction passage to be in communication with the common passage when the hose is connected to the second connector.

8. The robot cleaner of claim 7, wherein the passage switch includes a switch wall which is rotated in the common passage and shields the first suction passage or the second suction passage while being rotated, and a transmission which transmits power to the switch wall.

9. A robot cleaner comprising: a main body accommodating a suction motor configured to generate a suction force: a wheel configured to rotate, based on receiving a driving force, to automatically move the main body along a floor, and a suction head configured to clean the floor based on the suction force when in communication with the suction motor, wherein the main body includes: a first connector to which the suction head is coupled; an accommodating recess provided at a front of the main body, wherein when the suction head is coupled to the first connector, a portion of the suction head is received in the accommodating recess such that a first part of the suction head vertically overlaps a portion of the main body, and a second part of the suction head protrudes from sides and front of the main body, and a second connector to which a hose is selectively coupled, wherein the main body further includes: a common passage which is in communication with the suction motor; a first suction passage which is in communication with the suction head; a second suction passage which is in communication with the hose when coupled to the second connector, and a passage switch which allows one of the first suction passage or the second suction passage to be in communication with the common passage, and wherein the second connector is rotatably connected to the main body, and the passage switch is moved between a first position in which the first suction passage is in communication with the common passage and a second position in which the second suction passage is in communication with the common passage based on receiving a rotating force of the connector.

10. A robot cleaner comprising: a main body accommodating a suction motor configured to generate a suction force; a wheel configured to rotate, based on receiving a driving force, to automatically move the main body along a floor, and a suction head configured to clean the floor based on the suction force when in communication with the suction motor, wherein the main body includes: a first connector to which the suction head is coupled; an accommodating recess provided at a front of the main body, wherein when the suction head is coupled to the first connector, a portion of the suction head is received in the accommodating recess such that a first part of the suction head vertically overlaps a portion of the main body, and a second part of the suction head protrudes from sides and front of the main body, and a second connector to which a hose is selectively coupled, wherein the main body further includes: a common passage which is in communication with the suction motor; a first suction passage which is in communication with the suction head; a second suction passage which is in communication with the hose when coupled to the second connector; and a passage switch which allows one of the first suction passage or the second suction passage to be in communication with the common passage, and wherein the main body includes a cover that is movably provided over the second connector, and the passage switch is moved based on receiving a moving force of the cover.

* * * * *